United States Patent [19]

Toews

[11] 3,997,934

[45] Dec. 21, 1976

[54] DIRT RUNNER AND SUPPORT THEREFOR

[75] Inventor: Leonard E. Toews, Greensburg, Pa.

[73] Assignee: Kennametal Inc., Latrobe, Pa.

[22] Filed: Apr. 10, 1975

[21] Appl. No.: 566,955

[52] U.S. Cl. ..... 15/246; 15/83

[51] Int. Cl.[2] ..... E01H 1/04

[58] Field of Search ..... 15/78–87, 15/340, 345, 346, 246; 37/141 R, 142 R; 172/719

[56] References Cited

UNITED STATES PATENTS

| | | | |
|---|---|---|---|
| 564,013 | 7/1896 | Furnas | 15/346 X |
| 2,594,116 | 4/1952 | Beyer et al. | 15/83 |
| 2,637,055 | 5/1953 | Mott | 15/83 |
| 3,363,274 | 1/1968 | Tamny | 15/84 |
| 3,529,677 | 9/1970 | Stephenson | 37/141 R X |

*Primary Examiner*—Edward L. Roberts
*Attorney, Agent, or Firm*—Melvin A. Crosby

[57] ABSTRACT

A dirt runner, such as those used on street sweeping machines and the like, and a flexible support for the dirt runner to be attached to a housing portion. Flexible supports such as elongate strips of elastomeric material are fastened along the upper portion of the strips to the housing portion of the machine and the dirt runner is fastened along the lower portion of the elastomeric strip. The dirt runner is adequately supported to be driven in its longitudinal direction of travel and more freely flexible in lateral directions to its direction of travel. The dirt runner is uniquely designed to accommodate the additional feature of the flexible means such that the dirt runner and flexible means may be substituted directly to the existing street sweeper machines without modification thereof.

5 Claims, 11 Drawing Figures

DIRT RUNNER AND SUPPORT THEREFOR

BACKGROUND OF THE INVENTION

Dirt runners are devices that are used on street sweeping machines and the like. Dirt runners are typically mounted on some movable housing portion such that when a street sweeping machine is engaged with sweeping the pavement surface, the dirt runners can be lowered into sliding engagement with that pavement surface and thereby prevent dirt from escaping from under the machine and help guide the dirt along a predetermined path to a collection receptacle in the street sweeping machine.

A typical street sweeping machine might have a dust collection system whereby the dirt receptacle sits up on a bed of a truck, a suction system is provided and routed down through the bed of the truck. A brush rearwardly of the suction path is rotated so as to impel the dirt toward the suction opening, the suction pulling the dirt up into the dirt receptacle. Dirt runners are provided on lateral sides to guide the dirt along the desired path and improve the suction capability of the street sweeper.

The normal wear and tear on dirt runners is substantial due to the fact that there is down pressure exerted on the dirt runner against the pavement surface, the downward force being at least the weight of the dirt runner itself and the weight of the movable housing portion to which it is connected. The pavement surfaces which the dirt runners encounter is also very abrasive and irregular and, for this reason, it is preferable to have dirt runners equipped with hard wear resistant material on the surface that contacts the roadway. Usually, such a hard wear resistant material is in the form of a hard cemented metal carbide, such as tungsten carbide.

The dirt runners of the prior art are rigidly connected to a housing portion of the street sweepers, usually a movable housing portion such that the dirt sweepers may be raised or lowered when out of use or in use, respectively. The movable direction then is only in the vertical direction. The housing portion and the dirt runners being very rigid in lateral directions to the direction of travel of the dirt runners. The dirt runners, of course, are also very rigid in the direction of travel, also.

The problem that arises with dirt runners of the prior art is the serious and expensive damage that can occur to one of these street sweeping machines when encountering normal irregularities while enagaged with the pavement surface. The dirt runner by its nature is relatively narrow in width and, as it slides along the pavement surface with its downward pressure on it, it encounters cracks, crevices, or recesses in the pavement bed. Some of these recesses are made in the form of sewer grates with slotted surfaces and railroad track crossings with their attendant clearances in the road bed for the tracks.

If the street sweeping machine is traveling in a straight line as it encounters and passes these irregularities, no damage will occur. However, in practical experience, these obstructions are encountered during various maneuvers of the street sweeping machine. In turning, for instance, if the dirt runner becomes engaged with a grated sewer cover or drops into the clearances provided for railroad tracks at a railroad crossing, a severe lateral side force creates a bending movement on the dirt runner.

The dirt runners of the prior art are rigidly connected to and supported by a housing portion of the street sweeping machine and thereby this severe bending movement is transferred to the housing portion. The result, of course, ranges from a slight bending of the housing to a very pronounced bending of the housing, either of which may be enough to interfere with the rotary operation of the brushes of the sweeper or severely limit the suction system employed by the sweeper.

With the foregoing in mind, a primary object of the present invention is to provide dirt runners having a laterally flexible support between the dirt runner and the housing portion.

Another object of the present invention is to provide an arrangement whereby a greater life expectancy of the dirt runner may be anticipated before having to be returned for repairs or replaced.

Another object of the present invention is to eliminate the possibility of serious damage to the street sweepers housing section when the dirt runners encounter any of the above-listed damaging items during its maneuvers.

Another object of the present invention is to provide a newly designed dirt runner such that the dirt runner and flexible means of support may be substituted directly on standard street sweeping machines as they now exist without any costly or significant modification to the street sweeping machines in the field.

BRIEF SUMMARY OF THE INVENTION

According to the present invention, a dirt runner and flexible means of attachment are provided for in street sweeping machines and the like. The dirt runner is an elongate relatively flat bar-like member having a bottom surface for sliding engagement with a pavement surface. A groove is formed on the bottom surface of said dirt runner and a hard wear resistant material is disposed therein. The end portions of the bottom surface are sloped upwardly to allow the dirt runner to pass over certain road obstructions. On the top surface of the dirt runner member, lug means are provided for attachment to said flexible means.

The lug means can be a strip of angle iron or sections of angle iron attached to the top surface of said dirt runner by bolt means and attached to said flexible means by bolt means also. The lug means also can be ears protruding from the top surface and fastened along the longitudinal centerline of the top surface, as by welding, and connecting to said flexible means.

The flexible means of attachment is in the form of a resilient elongate strip of an elastomeric material or a textile reinfoced elastomeric material having bolt holes formed along its upper portion for attachment to a housing portion of the street sweeper and bolt holes along the bottom portion for attachment to said dirt runner. The flexible means may comprise one or more of said strips of elastomeric material.

Both the flexible means and the dirt runner are designed to be substituted directly for dirt runners of the prior art with very little or no modification to the street sweepers housing portion.

The exact nature of the present invention will become more clearly apparent upon reference to the following detailed specification taken in connection with the accompanying drawings in which.

DETAILED DESCRIPTION OF THE INVENTION

Figure 1:
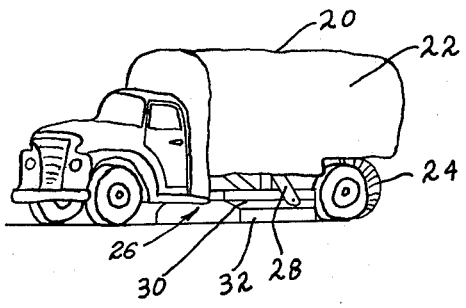
FIG. 1 is a general view of a dirt runner mounted on a street sweeping machine.

In FIG. 1 is shown a street sweeping machine 20 in the form of a truck having some form of dirt receptacle or suction system and dirt receptacle 22 and extending down from 22 a housing section 26 which may be in the form of a suction hood. The housing section 26 is generally open ended rearwardly facing a rotary brush 24 which upon rotation impels dirt particles and the like toward and into the housing section 22.

On housing section 22 is generally mounted an independently movable housing portion 30 and along the bottom edge of said housing portions 30 is mounted a dirt runner 32. Lever arm 28 is generally operable to raise and lower the dirt runners into sliding engagement with a pavement surface which helps to guide the dirt particles being impelled by the rotary brush and also improves the suction capability of the street sweeping machine if it is equipped with a suction system.

Figure 2:
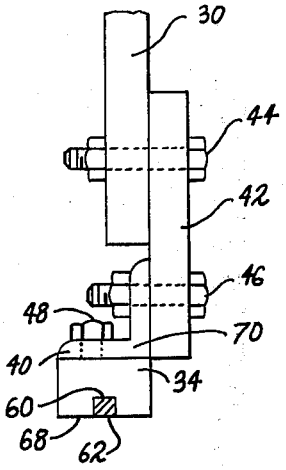
FIG. 2 is a cross sectional view of the new mounting arrangement disclosed herein.

Shown in FIG. 2 is a cross sectional view of the mounting arrangement and dirt runner of the present invention. Housing portion 30 is to resilient member 42 by bolt means 44. Resilient member 42 is an elongate strip of elastomeric material, preferably a textile fibered reinforced elastomeric material. Resilient member 42 is connected along its lower portion by bolt means 46 to a section of angle iron 40. A sufficient clearance is left between the housing portion 30 and the angle iron section 40 to allow lateral flexibility of dirt runner 34.

Dirt runner 34's top face 70 is connected by nut means 48 to a lower side face of angle iron section 40. The dirt runners lower face 68 is prepared for sliding engagement with a pavement surface by a longitudinal groove 60 formed therein, and hard wear resistant material 62 disposed in groove 60.

Figure 3:
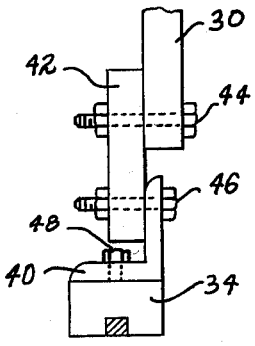
FIGS. 3, 4, 5 and 6 depict other possible mounting arrangements in cross sectional views.

FIG. 3 is a cross sectional view as similar to that of FIG. 2; however, the resilient member 42 is connected to housing portion 30 and angle iron 40 in a different configuration. The top portion of resilient member 42 is shown attached by bolt means 44 to the opposite side of housing portion 30 as shown in FIG. 2 and the lower portion of resilient means 42 is connected to angle iron 40 by bolt means 46 on an inward side of one of the side faces of angle iron section 40.

Figure 4:
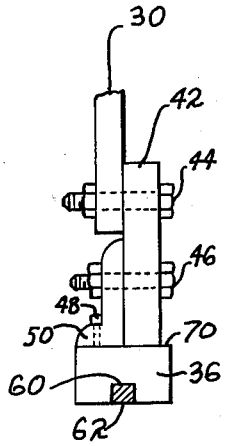

FIG. 4 shows still another arrangement for attachment in a cross sectional view. Herein, the connection made to dirt runner 36 by an "L" shaped bracket 50 is by a set of stud bolts welded along the top surface 70 of dirt runner 36 and being to one side of the longitudinal centerline of dirt runner 36. This then allows the resilient member 42, which is connected along its top portion by bolt means 44 to housing portion 30, to have its lower portion assembled flush to top surface 70 of dirt runner 36 and connected by bolt means 46.

Figure 5:
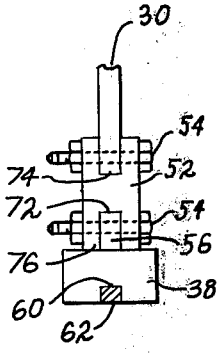

FIG. 5 shows still another arrangement for attachment in a cross sectional view. In this case, resilient member 52 is formed with longitudinal grooves 72 and 74 in its lower and upper edges, respectively, groove 74 formed to freely receive housing portion 30 therein and to connect by bolt means 54. The lower groove 72 is formed to freely receive protruding lug means 56 which are welded to the top surface 76 of dirt runner 38 and to be connected therewith by bolt means 54.

Figure 6:
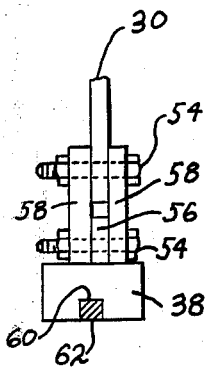

FIG. 6 is still another arrangement for attachment shown in cross section and is similar to that shown in FIG. 5. FIG. 6, however, has a flexible member 58 which comprises two elongate strips of elastomeric material running substantially parallel to one another. The top portion of the flexible members 58 are connected by bolt means 54 to housing portion 30 and the lower portions of flexible members 58 are connected by bolt means 54 to the protruding lug means 56 welded along the top surface of dirt runner 38. The flexible members 58 are disposed on each side of housing portion 30 and protruding lug means 56.

Figure 7:
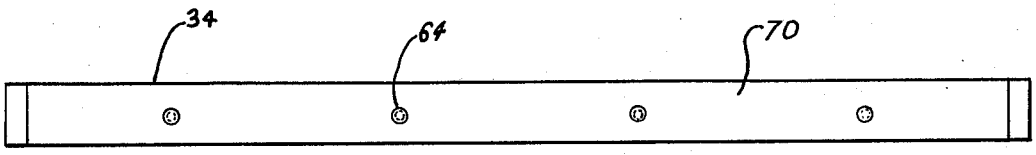
FIG. 7 is a top view of a dirt runner of the present invention.

FIG. 7 is a top view of the dirt runner 34 of the present invention looking down at top surface 70 thereof. Mounted on a longitudinal centerline thereof are threaded studs 64 protruding upwardly from top surface 70. While the threaded studs are mounted on a longitudinal centerline in this particular presentation, it is understood that they do not have to be so located in view of the mounting arrangement shown in FIG. 4. The W dimension is indicated in FIG. 7 to give an approximate representation of the relationship of width to height of the dirt runner of the present invention.

Figure 8:
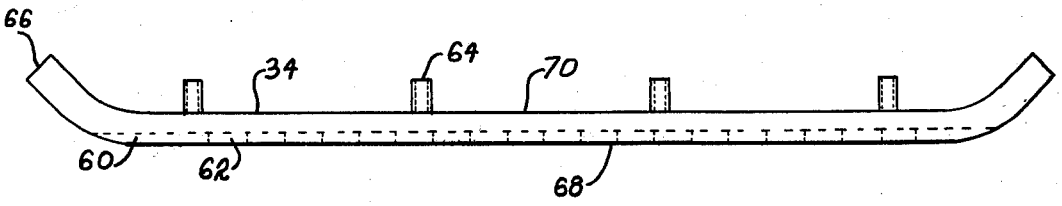
FIG. 8 is a side view of a dirt runner of the present invention.

In FIG. 8 is shown a side view of dirt runner 34 of the present invention. Threaded studs 64 are shown protruding perpendicularly from top surface 70 although not necessarily along its longitudinal centerline as shown in FIG. 7. Along the lower face 68, longitudinal groove 60 is shown with hard wear resistant inserts 62 disposed in groove 60 in end to end relation therealong. Longitudinal end portions 66 of dirt runner 34 are pictured sloping upwardly and away from the plane of bottom face 68 and, therefore, giving dirt runner 34 the ability to ride over fixed objects encountered on the pavement surface.

Figure 9:
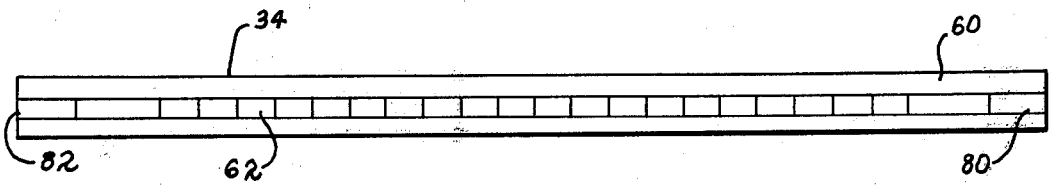
FIG. 9 is a bottom view of a dirt runner of the present invention.

In FIG. 9, the bottom face of dirt runner 34 is shown having a longitudinal groove 60 therein with hardened wear resistant sections being located in end to end relation in said groove. Clearance portions 80 and 82 of the groove have no hard wear resistant inserts 62 located therein in that these portions are located near end portions 66 which are sloped upwardly.

Figure 10:
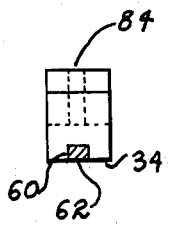
FIG. 10 is an end view of a dirt runner of the present invention.

In FIG. 10, an end view of dirt runner 34 is depicted in which is shown the longitudinal groove 60 with hard wear resistant inserts 62 disposed therein. Protuberance 84 shown therein can be either threaded studs or lug means mounted on the top surface of dirt runner 34. The height designation is to represent a comparison of the relative height to width of the dirt runner of the present invention in light of the prior art dirt runners whose height is usually an integral multiple of their width. The dirt runner of the present invention discloses dirt runners whose width is a multiple of their height.

Figure 11:
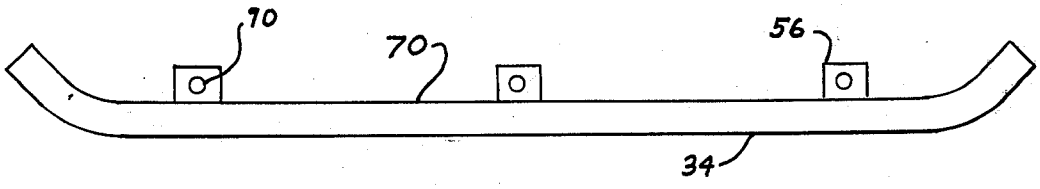
FIG. 11 is a side view of a dirt runner of the present invention with ear means mounted thereon.

FIG. 11 dirt runner 34 is shown having protruding ear means 56, protruding from top surface 70 of dirt runner 34. Bolt clearance hole 90 are formed in ear means 56 as engagement means with flexible members 58 or 52.

Modifications may be within the scope of the appended claims.

What is claimed is:

1. In a street sweeping machine which comprises a fore and aft extending housing portion and a dirt runner for sliding engagement with surface beneath the machine and mounted on said housing portion in depending relation thereto; said dirt runner comprising an elongate member extending in the fore and aft direction of the machine and rectangular when viewed from above, said member having a top surface and also having a bottom surface for sliding engagement with a pavement surface, said bottom surface having a longitudinal groove formed therein, and blocks of cemented hard metal carbide material disposed therein and fixed to said member, means upstanding from said top surface of said member for engagement with connector means to connect the member to the housing portion of the street sweeping machine, and said connector means comprising a fore and aft extending elongate strip of elastomeric material connected along the upper edge to the housing portion of the street sweeping machine and along the upper edge to said means upstanding from said member.

2. A street sweeping machine according to claim 1 in which said elastomeric material is more freely flexible in the lateral direction than in the fore and aft direction of said housing and member.

3. A street sweeping machine according to claim 1 in which said elastomeric material includes textile fiber reinforcing therein.

4. A street sweeping machine according to claim 1 in which said elastomeric material comprises two elongate strips along the length of the dirt runner with one on each side of said ear means.

5. A street sweeping machine according to claim 1 in which said hard metal carbide material includes tungsten carbide.

* * * * *